US007044232B2

(12) United States Patent
Jordon et al.

(10) Patent No.: US 7,044,232 B2
(45) Date of Patent: May 16, 2006

(54) WELL APPARATUS CONNECTION ASSEMBLY

(75) Inventors: Leslie Eric Jordon, Inverurie (GB); Keith Kettlewell, Methlick (GB)

(73) Assignee: Zenith Oilfield Technology Limited, Aberdeenshire (GB)

( * ) Notice: Subject to any disclaimer, the term of this patent is extended or adjusted under 35 U.S.C. 154(b) by 0 days.

(21) Appl. No.: 11/056,017

(22) Filed: Feb. 11, 2005

(65) Prior Publication Data

US 2005/0191889 A1 Sep. 1, 2005

(30) Foreign Application Priority Data

Feb. 13, 2004 (GB) ..... 0403238.9

(51) Int. Cl.
*E21B 19/16* (2006.01)

(52) U.S. Cl. ..... 166/380; 166/105; 166/241.6

(58) Field of Classification Search ..... 166/380, 166/382, 105, 117.7, 241.1, 242.2, 241.6, 166/24; 175/325.1, 325.5
See application file for complete search history.

(56) References Cited

U.S. PATENT DOCUMENTS 3,330,360 A * 7/1967 Young ..... 166/179
3,552,779 A 1/1971 Henderson
3,664,443 A 5/1972 Campbell
3,843,923 A 10/1974 deVries et al.
4,206,810 A 6/1980 Blackman
5,009,264 A 4/1991 Sliger et al.
5,323,856 A 6/1994 Davis et al.
5,666,050 A 9/1997 Bouldin et al.
6,033,567 A 3/2000 Lee et al.
6,497,278 B1 * 12/2002 Norris ..... 166/242.3

* cited by examiner

*Primary Examiner*—William Neuder
*Assistant Examiner*—Nicole A Coy
(74) *Attorney, Agent, or Firm*—Drinker Biddle & Reath LLP

(57) ABSTRACT

The invention discloses an apparatus and method for securing together longitudinal members for use in a well. A common application of the invention is for securing an electric submersible pumping assembly to a bypass tubing. Embodiments of the invention resist rotation of the members but allow the members a degree of axial movement with respect to each other. Thus differential thermal expansion of the members does not result in tension between the connections. During assembly of the members before deployment in the well, the various components which can make up the members can be moved and aligned axially with respect to each other in order fit together. This simplifies assembly of the various components.

13 Claims, 2 Drawing Sheets

WELL APPARATUS CONNECTION ASSEMBLY

FIELD OF THE INVENTION

The present invention relates to an apparatus and method used for connecting members suspended within a well and particularly but not exclusively to connecting an electrical submersible pump (ESP) assembly to a bypass tubing within a casing of an oil well.

BACKGROUND OF THE INVENTION

The deployment of electrical submersible pumping (ESP) assemblies within an adjacent guide tube is common practice in oil production wells. These systems enable equipment, for example equipment lowered on a wireline, to safely bypass the ESP assembly to the well below. The ESP assembly typically comprises a discharge head, a pump, a protector and electrically powered motors.

In use, the motor activates the pump to pump fluids from within the well casing to the surface via production tubing. The rotation of the motor and the pump causes vibration which can result in the adjacent bypass tubing unscrewing from its threaded connection to the production tubing which is normally jointed with parallel screw threads via a Y-block.

To prevent the bypass tubing from unscrewing and falling into the well, clamps are positioned at a variety of locations along the length of the ESP assembly to rigidly clamp the ESP assembly to the adjacent bypass tubing preventing it from rotating and unscrewing from the Y-block.

These clamps are also utilized to secure electrical cables connecting the ESP assembly within the well casing.

During operation the ESP assembly, particularly the motors, heat is generated which can lead to longitudinal expansion of the ESP assembly. Fluids passing the ESP assembly absorb heat generated by the ESP assembly, preventing an equivalent temperature rise in and similar longitudinal expansion of the bypass tubing. The rigid connections formed by the clamps between the bypass tubing and ESP assembly prevent unhindered longitudinal expansion of the ESP assembly, giving rise to undesirable bending stresses within the individual sub-assemblies of the ESP. Bending of the ESP sub-assemblies resulting from these undesirable stresses may result in excessive wear on shaft bearings and other components within the ESP sub-assemblies, leading to premature failure of the sub-assemblies and ultimately the ESP assembly in its entirety.

Substantial financial losses are incurred by such failures due to the costs of equipment replacement and to loss of production from the well.

SUMMARY OF THE INVENTION

According to a first aspect of the present invention there is provided an apparatus for use in a well comprising a connector; the connector having:

a first attachment mechanism adapted to rigidly connect to a first longitudinal member;

a second attachment mechanism adapted to connect with a second longitudinal member, such that rotational movement of the first longitudinal member is resisted but relative longitudinal movement of the first and second longitudinal members with respect to each other is permitted.

Typically the well is an oil well, the oil well may produce liquid or gaseous hydrocarbons.

Preferably the connector comprises a ring or bore which is adapted to allow longitudinal movement of the second longitudinal member therethrough. Preferably the connection between the connector and the second longitudinal member is not a rigid connection.

Preferably, the connector is a first connector.

Preferably, the apparatus comprises a second connector; the second connector having:

a first attachment mechanism adapted to rigidly connect to the second longitudinal member;

a second attachment mechanism adapted to connect with the first longitudinal member, such that relative longitudinal movement of the first and second longitudinal members with respect to each other is permitted.

Preferably the first attachment mechanism of the second connector comprises a clamp.

Preferably the second attachment mechanism of the second connector comprises a holding mechanism such as jaws. Typically the first longitudinal member is allowed to move in a longitudinal direction within the holding mechanism. Preferably therefore the connection between the second attachment mechanism and first longitudinal member is not a rigid connection.

Preferably the first longitudinal member comprises a bypass tubing.

Preferably the second longitudinal member comprises an electric submergible pumping (ESP) assembly. Typically the ESP assembly comprises a plurality of sub-assemblies, such as, a discharge head, a pump, a protector, an upper motor and a lower motor.

Preferably, the second connector is adapted to connect to the ESP assembly at a connection between two of the sub-assemblies.

Preferably, the apparatus comprises a plurality of second connectors, more preferably each connector is connected to the ESP assembly between two of the sub-assemblies.

Preferably the second longitudinal member comprises a rod extending therefrom. Typically the rod's main axis is parallel to the main axis of the second longitudinal member.

Preferably the first connector is adapted to connect with the rod of the second longitudinal member. Preferably, in use, the rod is permitted to move in a longitudinal direction through the first connector.

Preferably the rod comprises a collar to limit the longitudinal movement of the second longitudinal member with respect to the first longitudinal member. Preferably the collar is provided at the opposite end of the rod from the ESP assembly.

Preferably a second collar is provided on the rod at the opposite end to the first collar, that is the second collar is provided proximate to the ESP assembly. The second collar typically prevents the rod from disengaging with the first connector during assembly.

Preferably the second connectors are also adapted to secure wirelines, such as power cables or the like.

The invention also provides a method of connecting first and second longitudinal members together for use in a well, the method comprising;

rigidly connecting a first connector to the first longitudinal member;

connecting the first connector to the second longitudinal member, such that rotational movement of the first longitudinal member is resisted but relative longitudinal movement of the first and second longitudinal members with respect to each other is permitted.

Preferably the method of the invention is used with the apparatus in accordance with the first aspect of the invention.

Preferably the method also comprises:

connecting a second connector to the first longitudinal member;

rigidly connecting the second connector to the second longitudinal member, such that relative longitudinal movement of the first and second longitudinal members with respect to each other is permitted.

The first longitudinal member may comprise a bypass tubing.

The second longitudinal member may comprise an electric submergible pumping assembly.

According to a further aspect of the present invention, there is provided a method of connecting a first and substantially adjacent second longitudinal member to a third longitudinal member, said members suitable for use in a well; the method comprising:

rigidly connecting a connector to the first longitudinal member;

connecting the connector to the second longitudinal member such that longitudinal movement between the first and second members is permitted;

connecting one of the first and second longitudinal members to the third longitudinal member;

moving the other of the first and second members in a longitudinal direction with respect to the other of the first and second longitudinal members and connecting it to the third longitudinal member.

Preferably the method of the further aspect of the invention is used with the apparatus in accordance with the first aspect of the invention.

Typically the first longitudinal member comprises a bypass tubing, the second longitudinal member comprises an ESP assembly and the third longitudinal member comprises production tubing.

Preferably an interface is provided between the third longitudinal member and the first and second longitudinal members. Typically the interface is a Y-block.

BRIEF DESCRIPTION OF THE DRAWINGS

An embodiment of the present invention will now be described, by way of example only, with reference to the accompanying drawings in which.

DETAILED DESCRIPTION OF PREFERRED EMBODIMENTS

Figure 1:
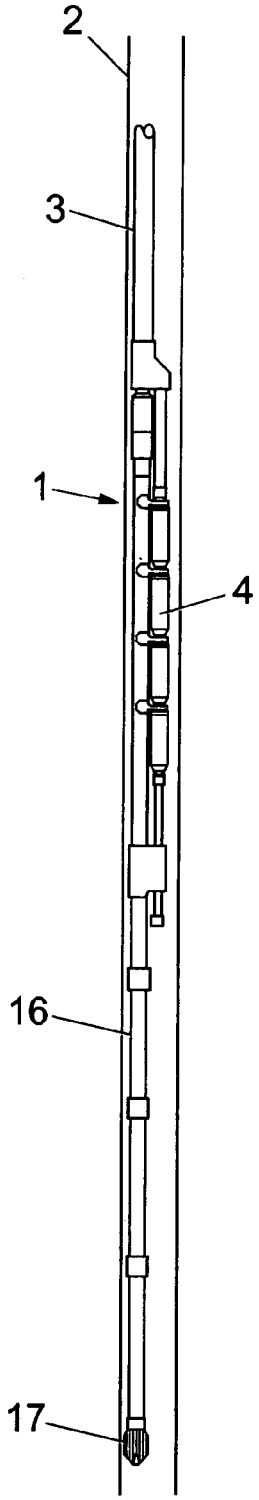
FIG. 1 is a diagrammatic view of a well showing a bypass system, ESP assembly and apparatus in accordance with the present invention.
Figure 2:
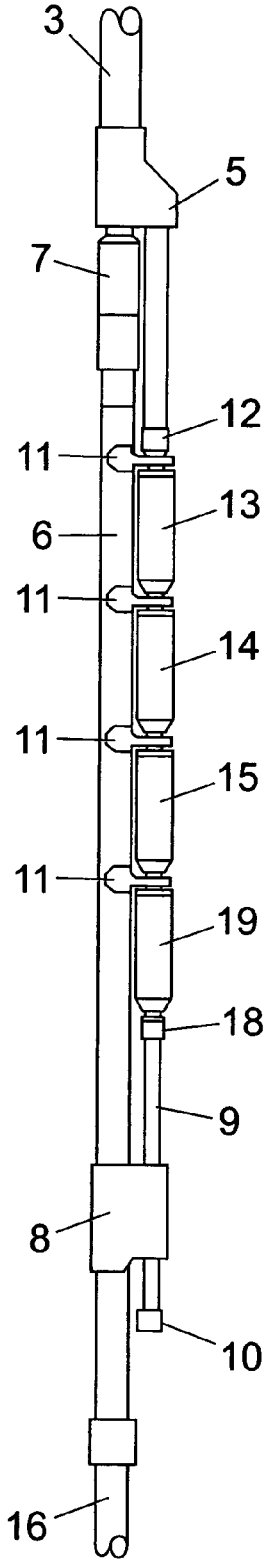
FIG. 2 is an enlarged view of the FIG. 1 bypass system, ESP assembly and apparatus.

Referring now to the figures, there is shown a bypass system 1 suspended within a wellbore 2 from production tubing 3. The bypass system 1 comprises a Y-block 5 which connects to a bypass tubing 6 via a rotary connector 7 to allow linear access from the production tubing 3 to the bypass tubing 6.

The Y-block 5 also connects to an electrical submergible pump (ESP) assembly 4 comprising a discharge head 12, pump 13, protector 14, an upper motor 15 and a lower motor 19.

A rod 9 is connected to the lower end of the ESP assembly 4. The rod 9 is co-linear with the ESP assembly 4.

Figure 3:
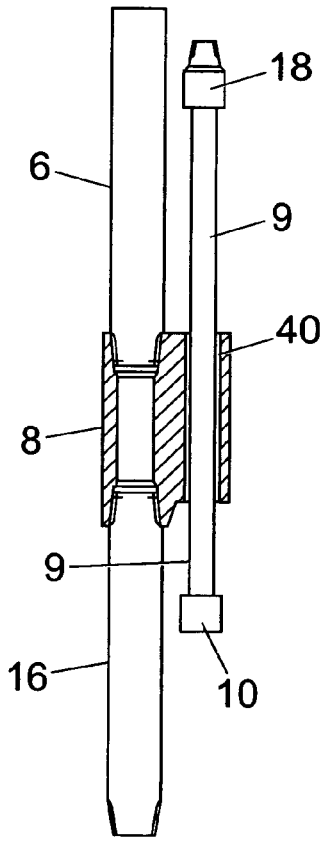
FIG. 3 is an enlarged view of a portion of the bypass tubing and apparatus of FIG. 1.

A connector or saddle 8, shown in more detail in FIG. 3, is rigidly connected to the bypass tubing 6. A bore 40 on the saddle 8 encloses the rod 9 extending from the ESP assembly 4. The rod 9 can slide through the bore 40 and thus move in a longitudinal direction with respect to the bypass tubing 6.

Figure 4A:
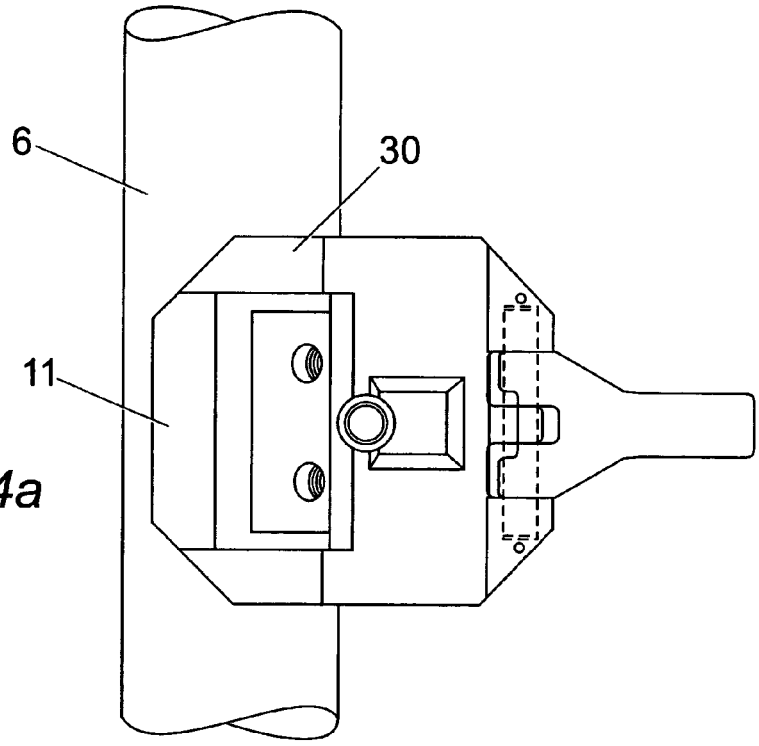
FIG. 4*a* is a side view of a clamp which forms part of the apparatus in accordance with the present invention and a portion of bypass tubing; and, FIG. 4*b* is a plan view of the FIG. 4*a* clamp, with an ESP assembly.
Figure 4B:
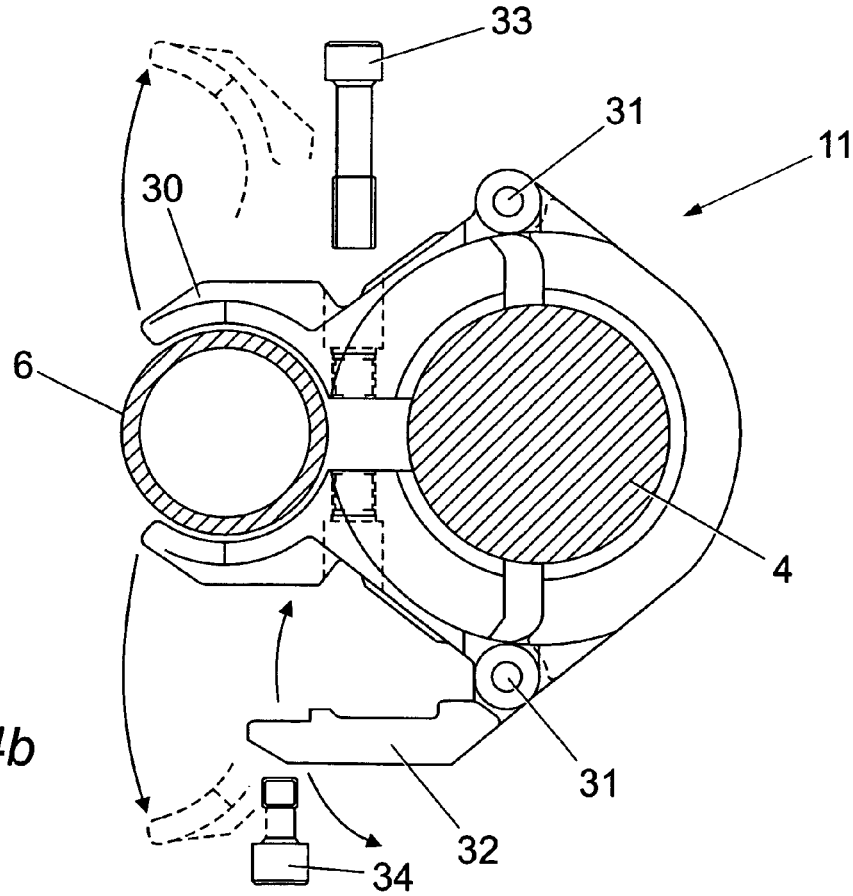

Clamps 11, shown in more detail in FIG. 4*b*, each comprise arms 30 to rigidly secure them to the ESP assembly 4 and to hold the bypass tubing 6 in place. However, in use, the bypass tubing 6 is free to slide through the arms 30 whereas the ESP assembly 4 is secured to the arms 30 and is not free to slide therethrough. This allows the clamps 11 and attached ESP assembly 4 to move in a longitudinal direction with respect to the bypass tubing 6.

The arms 30 can pivot around point 31 in order to be assembled or dis-assembled around the ESP assembly 4 and bypass tubing 6.

To secure the arms 30 in position around the ESP assembly 4 and bypass tubing 6, a female member 33 is placed through an aperture in the clamp 11 and is coupled with a male member 34 extending through an opposite aperture in the clamp 11.

The clamps 11 also serve to secure cables running to the ESP assembly 4, such as power and communication cables. A catch 32 is pivotally mounted at point 31 and secures cables between the catch 31 and the main body of the clamp 11.

A lower collar 10 is provided at the end of the rod 9 to prevent it from disengaging with the bore 40 of the saddle 8 in use. The rod 9 is long enough to cope with any amount of longitudinal movement of the ESP assembly 4 normally encountered in practice and so the collar 10 does not limit the relative longitudinal movement between the bypass tubing 6 and the ESP assembly 4.

A tailpipe 16 is suspended from the saddle 8 and is equipped with threaded connections common in the industry which are torqued to pre-determined values to prevent unscrewing, as is also common practice in the industry. Tailpipe 16 terminates at the wireline entry guide 17.

The bypass system 1 is made up at the surface in the conventional manner. The tailpipe 16 is placed in slips (not shown) of, for example, an offshore platform and the saddle 8 is secured thereto. The tailpipe 16 and saddle 8 are then placed on a workbench (not shown) of the offshore platform and a length of bypass tubing 6 is added.

The collar 10 of the rod 9 is removed to thread the rod 9 through the bore 40 of the saddle 8 and then replaced. The rod 9 is then attached to the lowermost sub-assembly of the ESP assembly 4, typically a lower motor 19. The assembled components are then lowered so that a clamp (not shown) on the workbench engages with a groove (not shown) on the outside of the motor 19. Since the rod 9 can slide freely through the bore 40 of the saddle 8, the bypass tubing 6 is lowered relative to the lower motor 19 until the collar 10 abuts with the saddle 8. The bypass tubing 6 is then supported by the workbench via the saddle 8 abutting with the collar 10 on the rod 9.

A further length of bypass tubing 6 can then be added followed by the upper motor 15. The assembled components are lowered again so that the clamp of the workbench can engage with a groove (not shown) in the upper motor 15 and so on until the whole ESP assembly 4 has been added and the bypass tubing 6 extends to almost the same height as the ESP assembly 4.

The top of the ESP assembly 4 is then secured to the Y-block 5. The assembled components are then lifted and lowered so that the workbench engages and supports the bypass tubing 6. The bypass tubing 6 then moves upwards by virtue of the rod 9 sliding through the saddle 8 to connect with the Y-block 5.

The clamps 11 can be mounted around the ESP assembly 4 and on bypass tubing 6 once the bypass system 1 has been completely assembled or alternatively during assembly of the system 1.

An advantage of certain embodiments of the present invention is that the relative lengths of the bypass tubing 6 compared to the ESP assembly 4 do not have to be accurately calculated since the bypass tubing 6 can move in a longitudinal direction with respect to the ESP assembly 4 during assembly in order for both to connect to the Y-block 5. Known systems with no such relative longitudinal movement require accurate calculation and accurate assembly in order to provide bypass tubing and an ESP assembly of the same height so that they can connect to a Y-block.

Thus embodiments of the present invention save time in assembling the bypass system and also do not require prior knowledge of the exact dimensions of the bypass tubing 6 and various components of the ESP assembly 4.

An upper collar 18 is provided on the rod 9 to prevent it from sliding out of the saddle 8 when the bypass tubing 6 is raised prior to the tubing joint 9 being screwed to the lower motor 19 of the ESP assembly 4.

Thus, in use, should the vibration caused by the pump 13 or motors 15, 19 of the ESP assembly 4 cause vibration in the bypass tubing 6, the saddle 8 will resist rotation of the bypass tubing 6 because it is rigidly secured thereto and aligned with the rod 9. The clamps 11 are oppositely configured, that is they are rigidly secured to the ESP assembly 4 and aligned with the bypass tubing 6 in order to resist the bypass tubing 6 from rotating around the ESP assembly 4.

Heat generated from the ESP assembly 4 causing it to expand relative to the bypass tubing 6 does not place an undue stress on embodiments of the invention because the clamps 11 move with the ESP assembly 4 and are not rigidly secured to the bypass tubing 6. Also, the rod 9 connected to the ESP assembly 4 is free to slide through the bore 40 of the saddle 8 and move in a longitudinal direction since it is not connected rigidly thereto. Thus, relative longitudinal movement of the ESP assembly 4 with respect to the bypass tubing 6 is provided for without hindrance or straining the connection therebetween. Rotation of the bypass tubing 6 is also resisted.

Certain embodiments of the present invention benefit in that expansion of the ESP assembly does not result in a strain developing between bypass tubing and an ESP assembly. Thus, failures of such equipment are less frequent, which saves costs in replacing equipment and the associated loss of production from wells when dealing with such failures.

Improvements and modifications may be made without departing from the scope of the invention.

We claim:

1. An apparatus for use in a well comprising a first connector, the first connector having:

a first attachment mechanism adapted to rigidly connect to a first longitudinal member;

a second attachment mechanism adapted to connect with a second longitudinal member, such that rotational movement of the first longitudinal member is resisted but relative longitudinal movement of the first and second longitudinal members with respect to each other is permitted;

a second connector, the second connector having:

a first attachment mechanism adapted to rigidly connect to the second longitudinal member; and a second attachment mechanism adapted to connect with the first longitudinal member, such that relative longitudinal movement of the first and second longitudinal members with respect to each other is permitted.

2. Apparatus as claimed in claim 1, wherein the first connector comprises a bore which is adapted to allow longitudinal movement of the second longitudinal member therethrough.

3. Apparatus as claimed in claim 1, wherein the first and second attachment mechanism of the second connector comprises a clamp having arms which are adapted to pivot around a point in order to connect with the first and second longitudinal members.

4. Apparatus as claimed in claim 1, wherein the second connector is also adapted to secure wirelines.

5. Apparatus as claimed in claim 1, wherein the first longitudinal member comprises a bypass tubing and the first connector is adapted to connect with the bypass tubing.

6. Apparatus as claimed in claim 1, wherein the second longitudinal member comprises an electric submersible pumping assembly and the first connector is adapted to connect therewith.

7. Apparatus as claimed in claim 6, wherein the apparatus further comprises a second connector, the second connector having:

a first attachment mechanism adapted to rigidly connect to the second longitudinal member; and a second attachment mechanism adapted to connect with the first longitudinal member, such that relative longitudinal movement of the first and second longitudinal members with respect to each other is permitted;

wherein the electric submersible pumping assembly comprises a plurality of sub-assemblies and the second connector is adapted to connect to the ESP assembly at a connection between two of the sub-assemblies.

8. Apparatus as claimed in claim 6, wherein the electric submersible pumping assembly comprises a rod extending therefrom, the rod's main axis being parallel to the main axis of the electric submersible pumping assembly, and the first connector being adapted to connect with the rod.

9. Apparatus as claimed in claim 8, wherein in use, the rod is permitted to move in a longitudinal direction through the first connector.

10. A method of connecting first and second longitudinal members together for use in a well, the method comprising:

rigidly connecting a first connector to the first longitudinal member;

connecting the first connector to the second longitudinal member, such that rotational movement of the first longitudinal member is resisted but relative longitudinal movement of the first and second longitudinal members with respect to each other is permitted;

connecting a second connector to the first longitudinal member; and rigidly connecting the second connector to the second longitudinal member, such that relative longitudinal movement of the first and second longitudinal members with respect to each other is permitted.

11. A method as claimed in claim 10, wherein the first longitudinal member comprises a bypass tubing.

12. A method as claimed in claim 10, wherein the second longitudinal member comprises an electric submersible pumping assembly.

13. A method of connecting a first and substantially adjacent second longitudinal member to a third longitudinal member, said members suitable for use in a well; the method comprising:

rigidly connecting a first connector to the first longitudinal member; connecting the first connector to the second longitudinal member such that longitudinal movement between the first and second members is permitted;

connecting one of the first and second longitudinal members to the third longitudinal member; and moving the other of the first and second members in a longitudinal direction with respect to the other of the first and second longitudinal members and connecting it to the third longitudinal member;

rigidly connecting a second connector to the second longitudinal member; and connecting the second connector to the first longitudinal member such that longitudinal movement between the first and second members is permitted.

* * * * *